US007392835B2

(12) United States Patent
Watkins et al.

(10) Patent No.: US 7,392,835 B2
(45) Date of Patent: Jul. 1, 2008

(54) JACKET AND SLAB CORE FASTENING APPARATUS

(75) Inventors: Gregory D. Watkins, Indianapolis, IN (US); Donald G. Wildrick, II, Indianapolis, IN (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 658 days.

(21) Appl. No.: 10/954,452

(22) Filed: Sep. 30, 2004

(65) Prior Publication Data

US 2005/0139343 A1 Jun. 30, 2005

Related U.S. Application Data

(63) Continuation-in-part of application No. 10/210,518, filed on Aug. 1, 2002, now Pat. No. 6,865,806.

(51) Int. Cl.
*B22D 33/04* (2006.01)

(52) U.S. Cl. ..... 164/339; 164/340; 164/341; 29/432; 29/798

(58) Field of Classification Search ..... 164/339, 164/340, 341; 29/432, 798, 712, 700
See application file for complete search history.

(56) References Cited

U.S. PATENT DOCUMENTS 4,609,030 A * 9/1986 Heater et al. ..... 164/137
7,257,885 B2 * 8/2007 Watkins et al. ..... 29/700

* cited by examiner

*Primary Examiner*—Kevin Kerns
*Assistant Examiner*—Ing-Hour Lin
(74) *Attorney, Agent, or Firm*—Jeffrey P. Calfa; Jack D. Nimz

(57) ABSTRACT

A water-jacket core and slab core for a V-block of an internal combustion engine are assembled into a jacket and slab sub-assembly and are placed on an apparatus for the automatic insertion of staples in the jacket and slab sub-assembly to thereby retain the water-jacket core and slab core together in the jacket and slab sub-assembly. The apparatus automatically positions four automatically operable staple guns so that each of the staples is inserted with one tine of each staple in the water-jacket core and the other tine of each staple in the slab core with the crown of each inserted staple lying across the interface between the assembled water-jacket core and slab core and retaining the water-jacket core and slab core together. As few as two staples per sub-assembly can be used to retain the water-jacket and slab core in their sub-assembly.

11 Claims, 1 Drawing Sheet

JACKET AND SLAB CORE FASTENING APPARATUS

RELATED APPLICATIONS

This patent application is a continuation-in-part of U.S. patent application Ser. No. 10/210,518, filed Aug. 1, 2002, now U.S. Pat. No. 6,865,806 which is hereby incorporated by reference.

FIELD OF THE INVENTION

This invention relates to apparatus for assembling and fastening together core elements of core assemblies, and more particularly, to apparatus for fastening together an assembly of the water jacket core and slab core of a V-block for an internal combustion engine.

BACKGROUND OF THE INVENTION

The manufacture of castings for internal combustion engines poses difficult manufacturing problems. For example, the manufacture of a V-block for an internal combustion engine frequently requires that large and unwieldy cores be placed together in a sub-assembly, which is then assembled with another core or placed in a casting mold. In one such operation, the water jacket core and slab core for casting a V-block engine must be assembled into a "jacket and slab" sub-assembly that is subsequently assembled in its entirety into a crankcase core. Because of their weight and size, the water jacket core and slab core of the "jacket and slab" sub-assembly are frequently separated and broken in handling, or are damaged since the cores are fragile and easily broken. These mishaps require production delays in which the production line is frequently stopped so that the broken or damaged cores can be removed.

In the past, adhesive and/or screws have been used to fasten core elements together to maintain the integrity of the core assembly during its handling and during pouring of the casting. The use of an adhesive requires an adhesive that can be easily spread on the core elements, that will set within the shortest possible time; that will hold the core elements together as one piece and maintain their position during the casting process, and that may be removed from the casting after the casting metal solidifies. This method results in substantial costs and opportunities for unreliable castings because of a potentially unreliable interface between the core elements. The adhesive materials may separate or otherwise become degraded in storage. It is also necessary that workmen apply the adhesive correctly so that the adhesive reliably maintains the core elements together during casting and is not spread onto an exposed casting surface. Furthermore, this method requires time for applying the adhesive, assembling the core elements together and allowing the adhesive to set before the core elements can be used for casting, and it introduces into the mold an unnecessary foreign element in the form of an adhesive that may evolve gas that may become trapped in the solidified casting and cause areas of possible failure. Because of the difficulties of using adhesive to fasten core elements together, screws have been used to fasten the core elements of core assemblies together. The use of screws requires the installation of accurately sized pins in the mold-form for the core to provide accurately sized holes in the core to accept the screws. Such pins in the mold-form became eroded by the abrasive core sand and bent in use, resulting in holes in the core that are too small or that cannot accept screws from an automatic installation station. As a result, screws frequently fail to properly engage the core sand core elements and to provide holding engagement of the core sand element as a result of core sand stripping during their installation.

Neither adhesive nor screws can satisfactorily fasten together assemblies of core elements, such as water jacket core, and slab cores for V-blocks of internal combustion engines.

BRIEF SUMMARY OF THE INVENTION

The invention provides an apparatus by which an assembly of core elements, such as an assembly including a water jacket core and slab core, can be easily and rapidly fastened together, avoiding their separation and breakage in subsequent handling, and eliminating associated production line delays, and includes the use of smooth surface fasteners, such as staples, as the fastener means.

The invention provides an apparatus for automatically fastening together one or more sets of assembled sand cores, each set including, for example, a water jacket core and a slab core for an internal combustion engine block. The apparatus of the invention comprises a support for the one or more sets of assembled sand cores, each of which, for example, includes a water jacket core and a slab core for an internal combustion engine, a plurality of movable carriers for a plurality of staple guns, each of the plurality of movable carriers being drivable between a retracted position and a staple insertion position adjacent the two sets of core assemblies on said support. Each of the movable carriers carries a plurality of staple guns and a supply of staples for each staple gun, an actuator for operating each staple gun and a staple sensor for sensing the insertion of staples from each of the staple guns. The apparatus further includes a core assembly sensor for sensing the presence of the one or more sets of assembled sand cores at their fastening positions on the support, and a control having first control means triggered by said core assembly sensor for actuating the movement of the plurality of movable carriers between their retracted positions and their staple insertion positions, second control means for operating the staple gun actuators when the movable carriers have reached their staple insertion positions, and third control means triggered by signals from the plurality of staple sensors for actuating the movement of the plurality of carrier drivers to their retracted positions. Preferably in the invention, each of the plurality of staple guns is located at the staple insertion position so that each of the plurality of staple guns inserts a single staple into both of assembled cores, each such single staple having one tine inserted into one of the cores and the other tine inserted into the other of the cores with the crown of the staple crossing the interface between the cores thereby retaining the cores of the one or more sets of assembled sand cores together. In the invention, the retracted positions of the plurality of movable carriers are preferably below the level of the support so that a work carrier, such as a pick-and-place robot, can place the one or more sets of assembled sand cores on the support without obstruction.

A preferable apparatus of the invention automatically fastens together two sets of assembled sand cores, each set including a water jacket core and a slab core for internal combustion engine block, and includes a table and a plurality of supports for the two sets of assembled sand cores, each of which extend upwardly from the table. A pair of movable carriers, each of which carry a pair of automatically operable staple guns, are provided, with one movable carrier and one pair of staple guns being located on one side of the table and the second movable carrier and pair of staple guns being located on the opposite side of the table. Each of the movable carriers have a retracted position below the level of the table and a staple insertion position in which each pair of staple guns is located adjacent the two sets of assembled sand cores which rest on the plurality of supports. The movable carriers further include actuators to move the plurality of automatically operable staple guns upwardly and inwardly from their retracted positions to their staple insertion positions. Each of the movable carriers carry, in addition to the pair of staple guns, two supplies of staples, one for each staple gun, and two staple insertion sensors, one for each staple gun. Core assembly sensor means adjacent to the table senses the presence of the two sets of assembled cores on the plurality of supports in position to be fastened together. A control for operating the apparatus includes first control means operated by the core assembly sensor means to operate the actuators of each of the pair of movable carriers and move the plurality of automatically operated staple guns from their retracted positions to their staple insertion positions, second control means for operating each of the plurality of staple guns and inserting staples into the two sets of assembled cores to retain each of the water jacket cores and slab cores together in the sub-assembly, and a third means operated by the staple insertion sensors for operating the actuators for the pair of movable carriers to move the pair of movable carriers to the retracted positions. In the apparatus, the retracted positions of the pair of movable carriers are below the level of the table and the staple insertion positions locates the ends of the plurality of staple guns adjacent the sides of the water jacket core and slab core in such a position that the plurality of staples are inserted into the assemblies with one tine of each inserted staple being placed in the water jacket core and the other tine of the staple being inserted into the slab core with the crown of the staple lying across the interface between the water jacket core and slab core, retaining the water jacket core and slab core in their sub-assembly.

Other features and advantages of the invention will be apparent from the accompanying drawings and the more detailed description of the invention that follows.

BRIEF DESCRIPTION OF THE DRAWINGS

FIG. 1 is a view from the side of an apparatus of the invention;

FIG. 2 is a view from above the apparatus of FIG. 1; and

FIG. 3 is a view from the side of a portion of the apparatus taken at a plane corresponding to line 3-3 of FIG. 1, and looking in the direction of the arrows.

DETAILED DESCRIPTION OF THE PREFERRED MODE OF THE INVENTION

Figures 1, 2, 3:
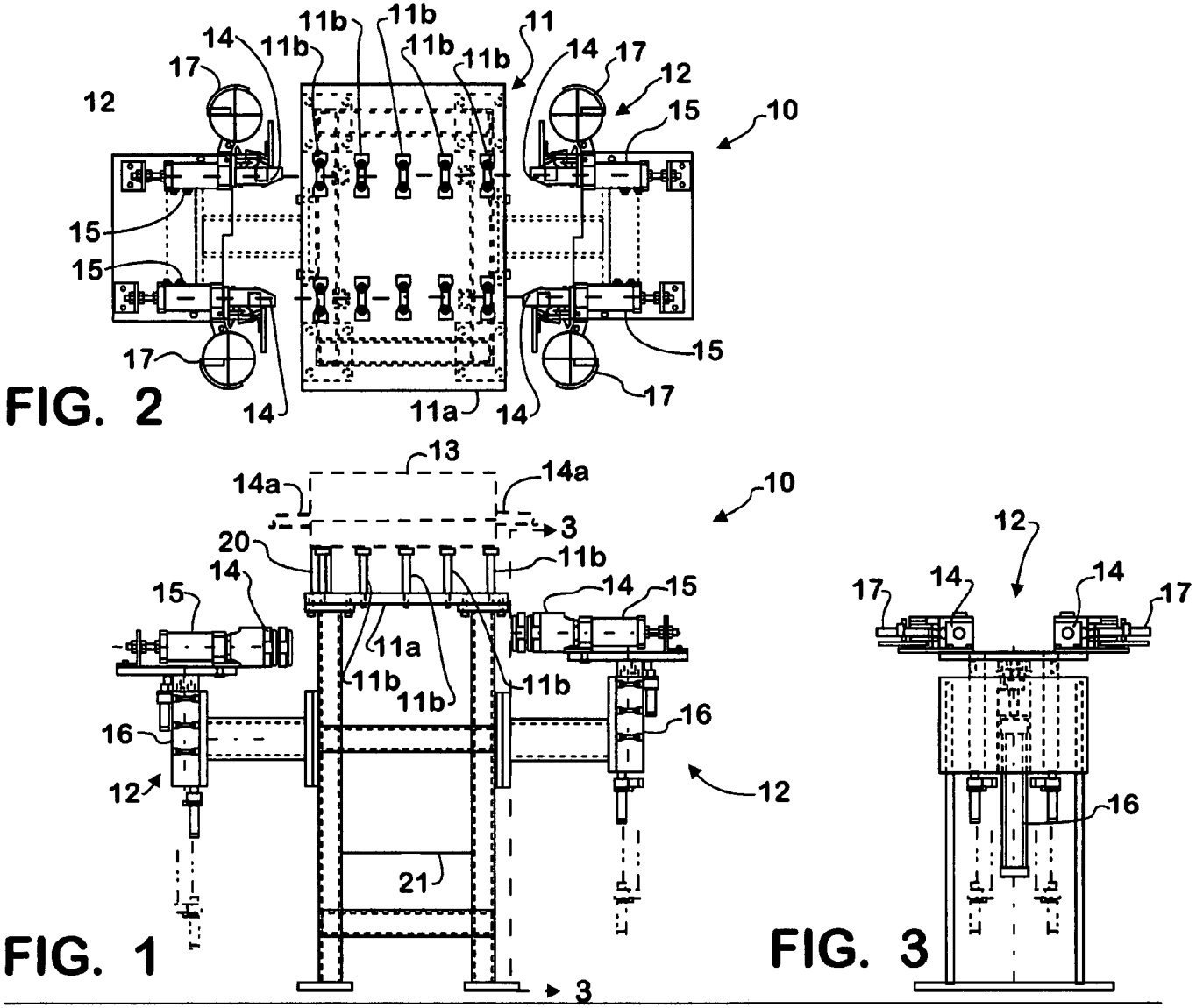
FIGS. 1, 2 and 3 illustrate one apparatus of the invention.

FIGS. 1, 2 and 3 illustrate a preferred apparatus 10 of the invention. FIG. 1 is a view from the side of the apparatus 10, and FIG. 2 is a view of the apparatus 10 from above. FIG. 3 is a side view taken from a plane perpendicular to the sheet on which the figures are drawn, through the line 3-3 in the direction of the arrows, to further illustrate one of the plurality of movable carriers 12.

The apparatus 10 is adapted to retain together two sets of assembled sand cores, each set including a water-jacket core and a slab core for a V-block of an internal combustion engine. As illustrated most clearly in FIG. 1, the apparatus includes a support 11 for two sets of assembled sand cores 13, one of which is illustrated in FIG. 1 by the dashed lines. The apparatus also includes a plurality of movable carriers 12 for a plurality of automatically operable staple guns 14. Preferably, each movable carrier 12 carries a pair of such staple guns 14, as show in FIGS. 1-3. Each of the plurality of movable carriers 12 is adapted to drive the pair of staple guns 14 between a retracted position illustrated in FIGS. 1-3 and a staple insertion position in which the staple guns 14 are positioned adjacent the core assemblies 13, as indicated by the dashed lines 14*a* in FIG. 1. A plurality of actuators 15, 16 move the plurality of staple guns 14 between their retracted positions and their staple insertion positions. In their staple insertion positions, each of the automatically operable staple guns 14 is oriented and located so that each of the plurality of staple guns inserts a single staple into the water-jacket core and the slab core, each single staple having one tine inserted into the water jacket core and the other tine inserted into the slab core with the crown of the staple lying across the interface between the water-jacket core and slab core. The invention permits a water jacket core and slab core to be retained in an assembly with as few as two staples.

In the preferred embodiment illustrated in FIGS. 1-3, each of the movable carriers 12 comprises a pair of actuators 15 for moving the pair of staple guns 14 horizontally, and an actuator 16 for moving the pair of staple guns 14 vertically. Each of the movable carriers 12 carries, in addition to the staple guns 14, a supply of staples 17 for each staple gun, which are best illustrated in FIG. 2, and a sensor (not shown) for providing an visual and/or audible signal when the supply of staples is reaching depletion and/or for stopping of the operation if a staple gun runs out of staples. Each of the movable carriers 12 also includes sensors for each staple gun (included in the staple guns and not otherwise indicated in FIGS. 1-3) for sensing the insertion of a staple from each staple gun. Sensor means 20, located at the support 11, senses the presence of the two sets of assembled sand cores on the support 11 in the position for insertion of the staples. Such core assembly sensor means 20 can preferable include one or more proximity sensors located to sense not only the presence, but the correct position, of the two sets of assembled sand cores.

The apparatus further includes a control 21 including first control means triggered by the core assembly sensor 20 for operating the plurality of actuators 15, 16 to move and locate the plurality of staple guns 14 in their staple insertion positions 14*a*. The control also includes a second control means for operating actuators for the staple guns 14 when the plurality of staple guns 14 have stopped at their staple insertion positions, and third control means triggered by signals from the plurality of staple sensors of the staple guns for operating the plurality of actuators 15, 16 and moving the plurality of movable carriers 12 and staple guns 14 to their retracted positions.

The plurality of carrier drivers 15, 16 can be any form of linear actuator, electric, hydraulic, or pneumatic, but preferably comprise air-operated piston-cylinders 15, 16 operated by said control with air valves (not shown) to move the staple guns vertically through the action of air-operated cylinders 16 and horizontally through the action of air-operated cylinders 15, to position the muzzle of the staple gun 14 directly against the assembled sand cores 13.

In the preferred apparatus of the invention illustrated in FIGS. 1-3, the support 11 comprises a table 11*a* and a plurality of supports 11*b* for the two sets of assembled cores that extend upwardly from the table 11*a*. The supports 11*b* allow clearance between the upper surfaces of the supports 11*b* that engage the assembled cores 13 and the upper surface of the table 11*a* to permit a work carrier, such as a pick-and-place robot, to approach the apparatus 10 from the sides over the retracted movable carriers 12, and lower the assembled cores 13 onto the upper surfaces of the plurality of supports 11*b*, and with further lowering of the work carrier to move away from the apparatus 10, leaving the assembled sand cores 13 in place on the upper surfaces of the plurality of supports 11*b*.

As illustrated by FIGS. 1-3, the apparatus preferably includes a pair of movable carriers 12 for the pair of staple guns 14, with one movable carrier 12 being located on one side of the support 11 and the second movable carrier 12 being located on the opposite side of the support 11, as shown in FIGS. 1-2. As set forth above, each of the movable carriers 12 carry two automatically operable staple guns 14 and two supplies of staples, one for each staple gun, and two staple insertion sensors that are incorporated into the staple guns and not shown in the figures. The core assembly sensor 20 senses the presence of two sets of assembled cores 13 on the plurality of supports 11*b* and begins operation of the apparatus as described above.

Thus, the invention provides an apparatus for automatically fastening together a plurality of assembled cores, such as a water jacket core and a slab core for an internal combustion engine block, including first means 11 for supporting the assembled cores in a predetermined fastening position, second means 20 for sensing the presence of the assembled cores at the predetermined fastening position, a plurality of third means 12 operated by the second means 20 for carrying a plurality of staple guns 14 between retracted positions and staple insertion positions adjacent the assembled cores 13, fourth means incorporated into the plurality of staple guns 14 operated by the second means 20 for operating the plurality of staple guns 14 when they have reached their staple insertions positions, and fifth means also incorporated into the plurality of sensor guns for sensing when the staples have been inserted from all staple guns 14 into the assembled cores 13 and for thereafter operating third means 12 returning the plurality of staple guns 14 to their retracted positions.

In one operation of the preferred production apparatus, two assemblies of water jacket cores and slab cores are formed and carried by a pick-and-place robot to a fastening apparatus 10. At the fastening apparatus 10, the two assemblies of sand cores are located by the pick-and-place robot and lowered onto a plurality of assembly supports 11*b* projecting upwardly from a table 11*a*. A core assembly sensor 20 senses the presence of the core two assemblies in proper location for fastening and operates a pair of movable carriers 12 by which a plurality of staple guns 14 are moved into location against the two core assemblies 13 for insertion of a plurality of staples into the water jacket cores and slab cores. Preferably, each fastener gun is an automatically operable staple gun, and is preferably positioned so that one tine of each staple is inserted into the water jacket core and the other tine of each staple is inserted into the slab core with the crown of the staple lying across the interfacing sides of the water jacket core and slab core to retain the assembled cores together. Upon completion of the fastening operation by insertion of all of the staples, the fastened assemblies 13 of core elements are removed from the plurality of supports by the pick-and-place robot for further processing.

The automatically operable staple guns preferably comprise Mezger's Stapling Head Part No. MEZ-A20-60 right hand and left hand, electronic staple sensor Part No. MEZ-Sensor-5, and electronic sensor conversion Part No. MEZ-VY63 PF. The two staple guns 14 on each movable carrier 12 are preferably spaced so that there is a distance of 12 inches between the staples inserted by each of the staple guns. While any form of sensor 20 can be used to sense the presence of the core assemblies in their fastening positions on the support 11, a proximity sensor that does not engage the core assemblies is preferred to reduce the risk of damage to the core assemblies.

Hoses, cables and other interconnections have been omitted from the FIGS. 1-3 to more clearly illustrate the apparatus 10 of the invention. Those skilled in the art will recognize how to interconnect the operating elements of the invention. Those skilled in the art will also recognize that the illustrated parts of the apparatus 10 may comprise many forms of structures and be controlled by many forms of control apparatus. The control means may include relays, and/or solid state controllers and control valves for controlling the application of compressed air to the preferred piston/cylinder actuators 15, 16 and, the operations of the staple guns.

The foregoing description is to be regarded as illustrative, rather than limiting, and it will be understood that it is the following claims, including all equivalents, that are intended to define the spirit and scope of this invention.

We claim:

1. An apparatus for automatically fastening together two sets of assembled sand cores, each set comprising a water jacket core and a slab core for an internal combustion engine block, comprising a table adapted to support two sets of assembled sand cores, which each include a water jacket core and a slab core for an internal combustion engine vehicle, at a fastening position, a plurality of movable carriers for a plurality of staple guns, each of said plurality of movable carriers being adapted to be driven between a retracted position and a staple insertion position adjacent the core assemblies at the fastening position, a plurality of carrier drivers for driving the plurality of movable carriers between their retracted positions and staple insertion positions, each of the plurality of staple guns being located at its staple insertion position so that each of the plurality of staple guns inserts a single staple into both the water jacket core and slab core, each such single staple having one tine inserted into the water jacket core and one tine inserted into the slab core with the crown of the staple crossing the interface between the water jacket core and slab core to retain the two sets of assembled sand cores together, each of the movable carriers carrying for each staple gun, a supply of staples, an actuator for operating the staple gun, and a staple insertion sensor for sensing the insertion of staples from the staple gun, core assembly sensing means for sensing the presence of the two sets of assembled sand cores at the fastening position, and a control having first control means triggered by said core assembly sensing means for operating the plurality of carrier drivers when two sets of assembled sand cores are present at the fastening position and moving the plurality of movable carriers to locate the plurality of staple guns at their staple insertion positions, second control means for operating the staple gun actuators when the movable carriers have stopped at their staple insertion positions, and third control means triggered by signals from the plurality of staple sensors for operating the plurality of carrier drivers and moving the plurality of movable carriers to their retracted positions.

2. An apparatus for automatically fastening together a plurality of assembled core sand elements in a core assembly, comprising first means for supporting an assembly of core elements in a predetermined fastening position, second means for sensing the presence and absence of an assembly of core elements at the predetermined fastening position, a plurality of third means for carrying a plurality of staple guns between retracted positions and staple insertion positions adjacent the assembly of core elements at the fastening position for insertion of staples into the assembly of core elements, fourth means for operating the plurality of staple guns and inserting staples into the assembly of core elements, and a plurality of fifth means for sensing when the plurality of staple guns has inserted staples into the assembly of core elements, control means for operation of the second, third, fourth and fifth means: to operate the third means when the second means senses an assembly of core elements at the predetermined fastening position; to operate the fourth means when the third means has located the plurality of staple guns at the staple insertion positions; and to operate the third means when the fifth means indicates that the plurality of staple guns have inserted staples into the assembly of core elements and move the plurality of third means to their retracted positions.

3. The apparatus of claim 2 wherein each of the plurality of staple guns is located at the staple insertion position so that each of the plurality of staple guns inserts a single staple into both the water-jacket core and slab core, each such single staple having one tine inserted into the water-jacket core and one tine inserted into the slab core, with the crown of the staple crossing the interface between the water-jacket core and slab core, thereby retaining the two sets of assembled sand cores together.

4. The apparatus of claim 2 wherein the first means comprises a table and a plurality of supports projecting upwardly from the table, and the plurality of third means comprises a plurality of staple gun carriers, with one staple gun carrier on each side of the supporting table.

5. The apparatus of claim 2 wherein the plurality of third means comprises a plurality of air-operated cylinders operated by said control to move the staple guns to the staple insertion position adjacent the assembled core sand element when said second means senses the presence of an assembled core elements at the fastening position and to move the staple guns to their retracted period when the fifth means has indicated that staples have been inserted from the plurality of staple guns into the assembly of core elements.

6. The apparatus of claim 2 wherein each of the plurality of assembled core sand elements comprises a water jacket core and a slab core for an internal combustion engine.

7. The apparatus of claim 2 wherein the plurality of assembled core sand elements comprises two sets of assembled core sand elements, each set comprising an assembled water jacket core and slab core for an internal combustion engine.

8. An apparatus for automatically fastening together two sets of assembled cores, each set of assembled cores comprising a water jacket core and a slab core for an internal combustion engine block, comprising a table, a plurality of supports for the two sets of assembled cores extending upwardly from the table, a pair of movable carriers, each carrying a pair of staple guns, with one movable carrier being located on one side of the table and the second movable carrier being located on the opposite side of the table, each of said movable carriers having a retracted position and a staple insertion position and actuators to move the pair of staple guns upwardly and inwardly from their retracted positions to their staple insertion positions, each of said movable carriers carrying two staple guns and staple gun operators, two supplies of staples, one for each staple gun, and two staple insertion sensors, one for each staple gun, core assembly sensor means for sensing the presence of two sets of assembled cores on the plurality of supports, and a control having first control means operated by said core assembly sensor means to operate the actuators of the pair of movable carriers and move the plurality of staple guns from their retracted positions to their staple insertion positions, second control means for operating said staple gun actuators and inserting staples into the two sets of assembled cores to retain the water jacket cores and slab cores together, and third control means operated by said staple insertion sensors for operating said actuators of said pair of movable carriers to return said pair of movable carriers to their retracted positions.

9. The apparatus of claim 8 wherein said actuators of said pair of movable carriers positions the ends of the plurality of staple guns for insertion of one tine of each inserted staple in the water-jacket core and the other tine of each inserted staple in the slab core, with the crown of each inserted staple lying across the interface between the water jacket core and slab core.

10. The apparatus of claim 8 wherein the retracted positions of said pair of movable carriers is below the level of said table.

11. The apparatus of claim 8 wherein said actuators of said pair of movable carriers places the ends of the plurality of staple guns against the sides of the water jacket core and slab core in the staple insertion position.

* * * * *